US009216606B2

(12) United States Patent
Noguchi et al.

(10) Patent No.: US 9,216,606 B2
(45) Date of Patent: Dec. 22, 2015

(54) RECORDING MEDIUM

(71) Applicant: CANON KABUSHIKI KAISHA, Tokyo (JP)

(72) Inventors: Tetsuro Noguchi, Hachioji (JP); Hisao Kamo, Ushiku (JP); Isamu Oguri, Yokohama (JP); Kazuhiko Araki, Kawasaki (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/311,142

(22) Filed: Jun. 20, 2014

(65) Prior Publication Data

US 2014/0377482 A1 Dec. 25, 2014

(30) Foreign Application Priority Data

Jun. 24, 2013 (JP) ..... 2013-131660

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/502* (2013.01); *B41M 5/504* (2013.01); *B41M 5/506* (2013.01); *B41M 5/508* (2013.01); *B41M 5/52* (2013.01); *B41M 5/5254* (2013.01)

(58) Field of Classification Search

CPC .. B41M 5/506; B41M 5/5218; B41M 5/5254; B41M 5/52; B41M 5/502; B41M 5/508

USPC ..... 428/32.24, 32.25, 32.28, 32.31, 32.34

See application file for complete search history.

(56) References Cited

U.S. PATENT DOCUMENTS

| | | | | |
|---|---|---|---|---|
| 2003/0072925 | A1 * | 4/2003 | Kiyama et al. | 428/195 |
| 2006/0172093 | A1 * | 8/2006 | Watanabe et al. | 428/32.24 |

FOREIGN PATENT DOCUMENTS

| | | | |
|---|---|---|---|
| EP | 2594407 | A1 | 5/2013 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 11-129611 | A | 5/1999 |
| JP | 2010-099991 | A | 5/2010 |
| JP | 2010-100976 | A | 5/2010 |
| JP | 2010100976 | A | 5/2010 |
| JP | 2013-022733 | A | 2/2013 |

* cited by examiner

*Primary Examiner* — Betelhem Shewareged

(74) *Attorney, Agent, or Firm* — Canon U.S.A. Inc., IP Division

(57) ABSTRACT

A recording medium includes a support and an ink-receiving layer. The ink-receiving layer contains alumina particles, silica particles and a binder. A composition analysis of the recording medium performed by X-ray photoelectron spectroscopy while etching is performed from a surface side to a support side provides a ratio of the amount of Si element to the total amount of Al element and Si element at an etching time of 0 minutes of 10 atomic percent or more and 90 atomic percent or less and a ratio of the amount of Si element to the total amount of Al element and Si element at an etching time of 5 minutes of 50 atomic percent or more.

9 Claims, 1 Drawing Sheet

RECORDING MEDIUM

BACKGROUND OF THE INVENTION

1. Field of the Invention

The present invention relates to a recording medium.

2. Description of the Related Art

With recent realization of high-speed image recording using an ink jet recording apparatus or the like, in addition to high color developability of an image, high ink absorbency has been desired for a recording medium on which ink is provided. Furthermore, high scratch resistance has also been desired for a recording medium because a strong force may be applied to the recording medium when the recording medium is conveyed at a high speed.

Hitherto, recording media in which polyvinyl alcohol having a silanol group (hereinafter also referred to as "silanol-modified PVA") is used as a binder of an ink-receiving layer have been studied for the purpose of improving ink absorbency and scratch resistance of the recording media (refer to Japanese Patent Laid-Open Nos. 11-129611, 2013-022733, 2010-099991, and 2010-100976). Japanese Patent Laid-Open Nos. 11-129611, 2013-022733, 2010-099991, and 2010-100976 disclose recording media that include an ink-receiving layer containing colloidal silica, which is an inorganic particle, and silanol-modified PVA.

SUMMARY OF THE INVENTION

A recording medium according to an aspect of the present invention includes a support and an ink-receiving layer. The ink-receiving layer contains alumina particles, silica particles and a binder. A composition analysis of the recording medium performed by X-ray photoelectron spectroscopy while etching is performed from a surface side to a support side in a direction substantially perpendicular to a surface of the recording medium using argon gas under application of a power of 25.6 W (4 kV×6.4 μA) at an etching angle of 45 degrees provides a ratio of the amount of Si element to the total amount of Al element and Si element at an etching time of 0 minutes of 10 atomic percent or more and 90 atomic percent or less and a ratio of the amount of Si element to the total amount of Al element and Si element at an etching time of 5 minutes of 50 atomic percent or more.

According to the aspect of the present invention, it is possible to provide a recording medium having high scratch resistance and high ink absorbency and having good color developability of an image.

Further features of the present invention will become apparent from the following description of exemplary embodiments with reference to the attached drawings.

DESCRIPTION OF THE EMBODIMENTS

Figure 1:
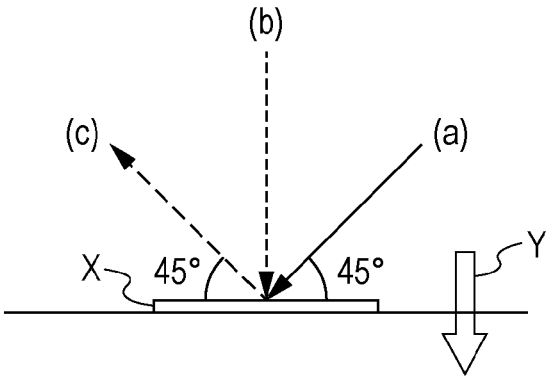
FIG. 1 is a schematic view illustrating an analytical method of a composition analysis by X-ray photoelectron spectroscopy in the present invention.

According to studies conducted by the inventors of the present invention, although the recording media described in Japanese Patent Laid-Open Nos. 11-129611, 2013-022733, 2010-099991, and 2010-100976 had improved scratch resistance and improved ink absorbency, the scratch resistance and the ink absorbency did not reach the levels that have been desired in recent years. In addition, color developability of an image was also low in some cases.

The present invention provides a recording medium having high scratch resistance and high ink absorbency and having good color developability of an image.

The present invention will now be described in detail using embodiments.

The inventors of the present invention first focused on the type of inorganic particles used in an ink-receiving layer, and conducted studies. As a result, it was found that it is important to use alumina particles or silica particles as the inorganic particles in order to improve ink absorbency and color developability of an image. The reason for this is that alumina particles and silica particles easily form a porous structure that absorbs ink, and that these particles have high transparency and thus color developability of an image is not easily impaired.

However, when alumina particles or silica particles were used alone, depending on the properties of the respective particles, the scratch resistance, the ink absorbability, and the color developability of an image could not be achieved in some cases. Specifically, in the case where alumina particles were used alone as inorganic particles in an ink-receiving layer, the alumina particles were easily deformed when the particles received a stress, and sufficient scratch resistance might not be obtained. On the other hand, silica particles have a property that the silica particles are not easily deformed when the particles receive a stress as compared with alumina particles. Therefore, in the case where silica particles were used alone as inorganic particles of an ink-receiving layer, scratch resistance was relatively high. However, ink absorbency and color developability of an image might be inferior to those in the case where alumina particles were used alone.

Accordingly, the inventors of the present invention studied a method in which alumina particles and silica particles were used in combination. However, in the case where alumina particles and silica particles were uniformly dispersed in an ink-receiving layer, although scratch resistance, ink absorbency, and color developability of an image were improved as compared with the case where alumina particles or silica particles were used alone, the three effects could not be achieved at high levels.

Next, the inventors of the present invention focused on the distribution state of alumina particles and silica particles in an ink-receiving layer, and conducted studies. Specifically, regarding recording media including ink-receiving layers having various distribution states of particles, the relationship between the distribution and the above three effects were studied. The distribution state of alumina particles and silica particles in an ink-receiving layer was evaluated as follows. A composition analysis was performed by X-ray photoelectron spectroscopy while etching was performed from the surface side to the support side of a recording medium. A ratio of the amount of Si element to the total amount of Al element and Si element (Si element/Al element+Si element) was then calculated. Details of this composition analysis, such as the measurement conditions, will be described later.

As a result, it was found that a recording medium in which the ratio Si element/Al element+Si element is 10 atomic percent or more and 90 atomic percent or less at an etching time of 0 minutes and 50 atomic percent or more at an etching time of 5 minutes can achieve the three effects at high levels.

The ratio Si element/Al element+Si element at "an etching time of 0 minutes" represents a distribution of alumina particles and silica particles on an outermost surface of a recording medium (ink-receiving layer). The ratio Si element/Al element+Si element at "an etching time of 5 minutes" represents a distribution of alumina particles and silica particles in a region just within (on the support side of) the outermost surface of the recording medium (ink-receiving layer). Specifically, the values of the ratio mean the following. In an ink-receiving layer of a recording medium in which the three effects could be obtained at high levels, on the outermost surface of the ink-receiving layer, alumina particles and silica particles coexist in a particular ratio. In the region just within the outermost surface, the alumina particles and the silica particles have a distribution in which the amount of silica particles is the same as the amount of alumina particles or the amount of silica particles is larger than the amount of alumina particles. Although the reason why the three effects can be achieved at high levels when an ink-receiving layer has the above distribution state of alumina particles and silica particles is not clear, the inventors of the present invention believe that the reason is as follows.

The region of "an etching time of 0 minutes", that is, the outermost surface of the recording medium (ink-receiving layer) is a region where ink first contacts the recording medium (ink-receiving layer) and is a region where the recording medium (ink-receiving layer) first receives an external stress. Therefore, it is believed that the effects can be achieved by the presence of alumina particles, which have higher ink absorbency and higher color developability of an image and silica particles, which have higher scratch resistance. Furthermore, when alumina particles and silica particles are used in combination, the alumina particles and the silica particles are aggregated, and thus larger pores are easily formed as compared with the case where alumina particles or silica particles are used alone. It is believed that since the volume of ink absorbed is increased by the presence of these pores, the ink absorbency is further increased.

On the other hand, in the region just within the outermost surface, the ink-receiving layer has a distribution in which the amount of silica particles is the same as the amount of alumina particles or the amount of silica particles is larger than the amount of alumina particles. That is, the ink-receiving layer has a distribution in which the amount of silica particles, which have higher scratch resistance, is not smaller than the amount of alumina particles, which have a scratch resistance lower than that of silica particles. It is believed that, with this distribution, a high resistance to an external stress received on the outermost layer can be maintained.

As described above, an important point in the present invention lies in that a region which is generally considered as a single region in the vicinity of the outermost surface of an ink-receiving layer is separately considered as "a region of the outermost surface" and "a region just within the outermost surface", and that the distribution state of alumina particles and silica particles in each of the regions is specified.

According to studies conducted by the inventors of the present invention, it was further found that when the ratio of the amount of Si element to the total amount of Al element and Si element at an etching time of 20 minutes is 90 atomic percent or less, ink absorbency is further increased.

The effects of the present invention can be achieved when the above configurations synergistically affect each other in accordance with the mechanism described above.

[Recording Medium]

A recording medium of the present invention comprises a support and at least one ink-receiving layer. In the present invention, the recording medium may be a recording medium for ink jet, the recording medium being used in an ink jet recording method.

In the present invention, an arithmetic average roughness Ra of a surface of a recording medium, the arithmetic average roughness Ra being specified in JIS B 0601:2001, is preferably 0.13 μm or less. Furthermore, the arithmetic average roughness Ra is more preferably 0.05 μm or more, and particularly preferably 0.10 μm or more. Examples of a method for adjusting a surface roughness of a recording medium include a method in which a support coated with a polymer is used, a roll having a particular roughness is pressed onto a surface of the support coated with the polymer, and a coating liquid for forming an ink-receiving layer (hereinafter also referred to as "ink-receiving layer coating liquid") is then applied onto the surface, and a method in which a roll having a particular roughness is pressed onto a surface of a recording medium.

Components constituting a recording medium of the present invention will now be described.

<Support>

Examples of materials that can be used as a support include paper, films, glass and metals. Among these, a support that uses paper, so-called base paper, is preferably used.

In the case where base paper is used, only base paper may be used as a support or base paper coated with a polymer layer may be used as a support. In the present invention, a support including base paper and a polymer layer is preferably used. In such a case, the polymer layer may be provided only on one surface of the base paper, but the polymer layer is preferably provided on both surfaces of the base paper.

(Base Paper)

The base paper is produced by using wood pulp as a main raw material and optionally adding synthetic pulp composed of polypropylene or the like or synthetic fiber composed of nylon, polyester, or the like to make paper. Examples of the wood pulp include laubholz bleached kraft pulp (LBKP), laubholz bleached sulfite pulp (LBSP), nadelholz bleached kraft pulp (NBKP), nadelholz bleached sulfite pulp (NBSP), laubholz dissolving pulp (LDP), nadelholz dissolving pulp (NDP), laubholz unbleached kraft pulp (LUKP) and nadelholz unbleached kraft pulp (NUKP). These may be used alone or in combination of two or more thereof, as required. Among these various types of wood pulp, LBKP, NBSP, LBSP, NDP, and LDP, all of which have a high content of a short fiber component, are preferably used. The pulp is preferably chemical pulp (sulfate pulp or sulfite pulp) that has a low impurity content. Pulp subjected to a bleaching treatment to improve the degree of whiteness is also preferable. A sizing agent, a white pigment, a paper-strengthening agent, a fluorescent brightening agent, a water-retaining agent, a dispersant, a softening agent, and the like may be added to the base paper, as required.

In the present invention, the thickness of the base paper is preferably 50 μm or more and 130 μm or less, and more preferably 90 μm or more and 120 μm or less. In the present invention, the thickness of the base paper is calculated by the following method. First, a cross section of a recording medium is cut with a microtome, and the cross section is observed with a scanning electron microscope. Next, the thicknesses at arbitrary 100 points or more of the base paper are measured, and the average thereof is defined as the thickness of the base paper. Thicknesses of other layers in the present invention are also calculated by the same method.

In the present invention, a paper density of the base paper, the paper density being specified in JIS P 8118, is preferably 0.6 g/cm$^3$ or more and 1.2 g/cm$^3$ or less. Furthermore, the paper density is more preferably 0.7 g/cm$^3$ or more and 1.2 g/cm$^3$ or less.

(Polymer Layer)

In the present invention, in the case base paper is coated with a polymer, it is sufficient that a polymer layer is provided so as to cover a part of a surface of the base paper. Furthermore, a coverage of the polymer layer (area of surface of base paper coated with polymer layer/total area of surface of base paper) is preferably 70% or more, and more preferably 90% or more. The coverage of the polymer layer is particularly preferably 100%, that is, particularly preferably, the entire surface of a surface of base paper is coated with a polymer layer.

In the present invention, the thickness of the polymer layer is preferably 20 μm or more and 60 μm or less, and more preferably 35 μm or more and 50 μm or less. In the case where a polymer layer is provided on both surfaces of the base paper, each of the thicknesses of the polymer layers on the two surfaces preferably satisfies the above range.

A thermoplastic polymer is preferably used as the polymer in the polymer layer. Examples of the thermoplastic polymer include acrylic polymers, acrylic silicone polymers, polyolefin polymers and styrene-butadiene copolymers. Among these polymers, polyolefin polymers are preferably used. In the present invention, the term "polyolefin polymer" refers to a polymer obtained by using an olefin as a monomer. Specific examples thereof include homopolymers of ethylene, propylene, isobutylene, or the like and copolymers thereof. These polyolefin polymers may be used alone or in combination of two or more polymers, as required. Among these, polyethylene is preferably used. Low-density polyethylene (LDPE) and high-density polyethylene (HDPE) are preferably used as polyethylene.

In the present invention, the polymer layer may contain a white pigment, a fluorescent brightening agent, an ultramarine blue pigment, etc. in order to adjust opacity, the degree of whiteness, and hue. Among these, a white pigment is preferably contained because opacity can be improved. Examples of the white pigment include rutile-type titanium oxide and anatase-type titanium oxide. In the present invention, the content of the white pigment in the polymer layer is preferably 3 $g/m^2$ or more and 30 $g/m^2$ or less. In the case where a polymer layer is provided on both surfaces of base paper, the total content of the white pigment in the two polymer layers preferably satisfies the above range. The content of the white pigment in the polymer layer is preferably 25% by mass or less relative to the content of the polymer. When the content of the white pigment is higher than 25% by mass, dispersion stability of the white pigment may not be sufficiently obtained.

In the present invention, an arithmetic average roughness Ra of the polymer layer, the arithmetic average roughness Ra being specified in JIS B 0601:2001, is preferably 0.01 μm or more and 5 μm less, and more preferably 0.03 μm or more and 4 μm less.

<Ink-Receiving Layer>

In the present invention, an ink-receiving layer includes alumina particles, silica particles and a binder. In the present invention, an ink-receiving layer including alumina particles, silica particles and a binder is preferably an ink-receiving layer on the outermost surface of the recording medium. Furthermore, the ink-receiving layer may be a single layer or a multilayer including two or more layers. The ink-receiving layer may be provided only on one surface of the support. Alternatively, the ink-receiving layer may be provided on both surfaces of the support. In the present invention, the ink-receiving layer is preferably provided on both surfaces. The thickness of the ink-receiving layer on one surface of the support is preferably 10 μm or more and 60 μm or less, and more preferably 15 μm or more and 45 μm or less. (Ratio of amount of Si element to total amount of Al element and Si element)

As described above, in the present invention, the ratio of the amount of Si element to the total amount of Al element and Si element is determined by conducting a composition analysis by X-ray photoelectron spectroscopy while etching is performed from the surface side to the support side in a direction substantially perpendicular to a surface of a recording medium. In the recording medium of the present invention, the ratio of the amount of Si element to the total amount of Al element and Si element (Si element/Al element+Si element) at an etching time of 0 minutes is 10 atomic percent or more and 90 atomic percent or less, and the ratio Si element/Al element+Si element is 50 atomic percent or more at an etching time of 5 minutes. At an etching time of 0 minutes, the ratio is preferably 40 atomic percent or more and 90 atomic percent or less, and more preferably 60 atomic percent or more and 80 atomic percent or less. At an etching time of 5 minutes, the ratio is preferably 50 atomic percent or more and 99 atomic percent or less, and more preferably 75 atomic percent or more and 95 atomic percent or less. Furthermore, at an etching time of 20 minutes, the ratio is preferably 90 atomic percent or less, more preferably 80 atomic percent or less, and particularly preferably 15 atomic percent or more and 50 atomic percent or less.

A method of the composition analysis will be described with reference to FIG. 1. First, a recording medium is cut to have a predetermined size (in Examples of the present invention, 1 cm×1 cm). Thus, a sample X is prepared. Subsequently, a composition analysis is performed by X-ray photoelectron spectroscopy while the sample X is etched under application of argon gas. In the present invention, the phrase "etching is performed from the surface side to the support side in a direction substantially perpendicular to a surface of a recording medium" means that etching is performed in the Y direction in FIG. 1. The etching is performed by using argon gas under application of a power of 25.6 W (4 kV×6.4 μA). The etching is performed in a predetermined region (in Examples of the present invention, 2 mm×2 mm) in the sample X at an etching angle of 45 degrees ((*a*) in FIG. 1). In Examples of the present invention, the composition analysis by X-ray photoelectron spectroscopy was performed as follows. A Kα line (1,486.7 eV) of Al was used as an X-ray source, an X-ray was applied to a sample X from a direction perpendicular to the sample X ((*b*) in FIG. 1), and an analysis was performed at a photoelectron acceptance angle of 45 degrees ((*c*) in FIG. 1). The X-ray output at this time was 25 W (15 kV×1.7 mA), and a spot having a diameter ϕ of 100 μm was used as a measurement area.

Figure 2:
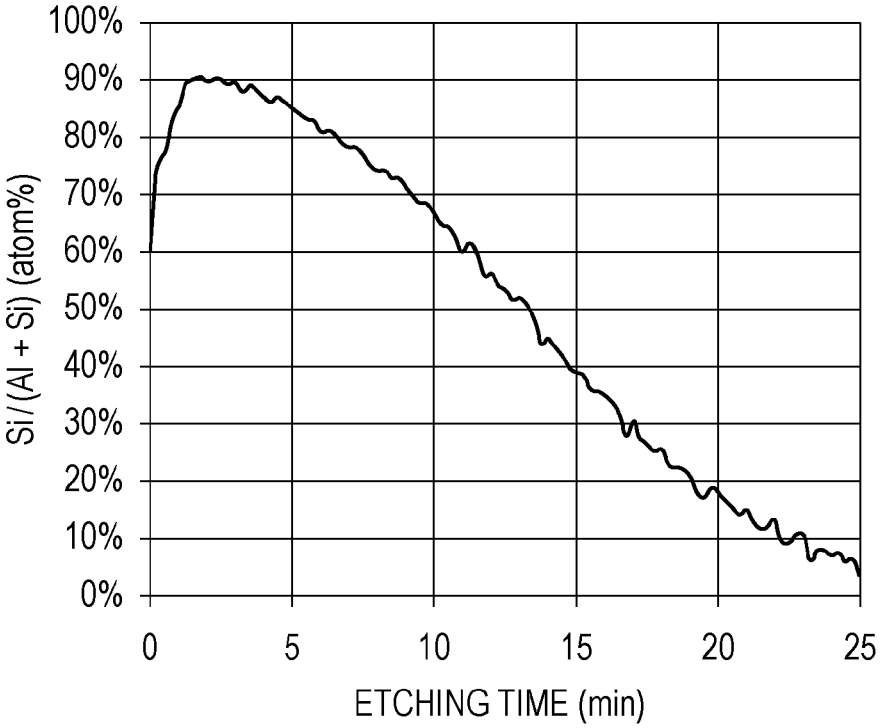
FIG. 2 is a graph showing an example of the results of a composition analysis by X-ray photoelectron spectroscopy in the present invention.

FIG. 2 shows the results of the composition analysis. In the graph shown in FIG. 2, the horizontal axis represents the etching time and the vertical axis represents the ratio of the amount of Si element to the total amount of Al element and Si element (Si element/Al element+Si element).

Materials that can be incorporated in the ink-receiving layer will now be described.

(Alumina Particles)

In the present invention, an average primary particle size of alumina particles is preferably 5 nm or more and 50 nm or less, more preferably 10 nm or more and 40 nm or less, and particularly preferably 10 nm or more and 30 nm or less. In the present invention, the average primary particle size of alumina particles is a number-average particle size of the diameters of circles having the areas equal to the projected areas of primary particles of the alumina particles when the alumina particles are observed with an electron microscope.

In this case, the measurement is conducted at least 100 points or more.

In the present invention, an average secondary particle size of alumina particles is preferably 10 nm or more and 1,000 nm or less, more preferably 30 nm or more and 300 nm or less, and particularly preferably 50 nm or more and 300 nm or less. The average secondary particle size of alumina particles can be measured by a dynamic light scattering method.

In the present invention, examples of alumina particles used in an ink-receiving layer include alumina hydrate and fumed alumina. In the present invention, alumina hydrate and fumed alumina are preferably used in combination. This is because, by using alumina hydrate, which has good color developability, and fumed alumina, which has good ink absorbency in combination, ink absorbency and color developability can be realized at high levels as compared with the case where alumina hydrate or fumed alumina is used alone.

Alumina hydrate that can be suitably used in the ink-receiving layer is one represented by a formula:

$$Al_2O_{3-n}(OH)_{2n}.mH_2O$$

(where n represents 0, 1, 2, or 3, m is 0 or more and 10 or less, preferably 0 or more and 5 or less, however, m and n are not zero at the same time.) Note that m may not represent an integer because, in many cases, $mH_2O$ represents an eliminable aqueous phase that does not participate in the formation of a crystal lattice. In addition, m can reach zero when the alumina hydrate is heated.

In the present invention, alumina hydrate can be produced by a known method. Specifically, examples thereof include a method in which an aluminum alkoxide is hydrolyzed, a method in which sodium aluminate is hydrolyzed and a method in which an aqueous solution of sodium aluminate is neutralized by adding an aqueous solution of aluminum sulfate or aluminum chloride thereto.

Known crystal structures of alumina hydrate include amorphous, gibbsite and boehmite in accordance with a heat-treatment temperature. The crystal structures of alumina hydrate can be analyzed by X-ray diffractometry. In the present invention, among these, amorphous alumina hydrate or alumina hydrate having a boehmite structure is preferably used. Specific examples thereof include alumina hydrate described in, for example, Japanese Patent Laid-Open Nos. 7-232473, 8-132731, 9-66664, and 9-76628. Examples of commercially available alumina hydrate include DISPERAL HP14 and HP18 (both of which are manufactured by Sasol). These alumina hydrates may be used alone or in combination of two or more thereof, as required.

In the present invention, alumina hydrate preferably has a specific surface area of 100 $m^2/g$ or more and 200 $m^2/g$ or less and more preferably 125 $m^2/g$ or more and 175 $m^2/g$ or less, the specific surface area being determined by a BET method. The BET method is a method in which a molecule or an ion having a known size is allowed to be adsorbed on a surface of a sample, and the specific surface area of the sample is measured on the basis of the amount of adsorption. In the present invention, the specific surface area of alumina hydrate determined by the BET method is a value obtained when nitrogen gas is used as a gas that is allowed to be adsorbed on the alumina hydrate.

Alumina used in the ink-receiving layer is preferably fumed alumina. Examples of such fumed alumina include γ-alumina, α-alumina, δ-alumina, θ-alumina and χ-alumina. Among these, from the viewpoint of the optical density of an image and ink absorbency, γ-alumina is preferably used. Specific examples of fumed alumina include AEROXIDE Alu C, Alu 130, and Alu 65 (all of which are manufactured by EVONIK Industries).

In the present invention, the specific surface area of fumed alumina determined by the BET method is preferably 50 $m^2/g$ or more, and more preferably 80 $m^2/g$ or more. The specific surface area of fumed alumina is preferably 200 $m^2/g$ or less, and more preferably 100 $m^2/g$ or less. In the present invention, the specific surface area of fumed alumina determined by the BET method is a value obtained when nitrogen gas is used as a gas that is allowed to be adsorbed on the fumed alumina.

Alumina particles used in the present invention may be blended in an ink-receiving layer coating liquid in the form of an aqueous dispersion liquid. An acid may be used as a dispersant for the aqueous dispersion liquid. A sulfonic acid represented by a formula below is preferably used as the acid because an effect of suppressing bleeding of an image can be obtained:

$$R—SO_3H$$

(where R represents any one of a hydrogen atom, an alkyl group having 1 to 4 carbon atoms, or an alkenyl group having 1 to 4 carbon atoms, and R may be substituted with an oxo group, a halogen atom, an alkoxy group, or an acyl group.) In the present invention, the content of the acid is preferably 1.0% by mass or more and 2.0% by mass or less, and more preferably 1.2% by mass or more and 1.6% by mass or less relative to the content of alumina particles.

In the case where alumina hydrate and fumed alumina are used as alumina particles in combination, the content (% by mass) of alumina hydrate contained in the ink-receiving layer is preferably 1.5 times or more and 9.0 times or less the content (% by mass) of fumed alumina in a mass ratio.

(Silica Particles)

In the present invention, an average primary particle size of silica particles is preferably 5 nm or more and 100 nm or less. In the present invention, the average primary particle size of silica particles is a number-average particle size of the diameters of circles having the areas equal to the projected areas of primary particles of the silica particles when the silica particles are observed with an electron microscope. In this case, the measurement is conducted at least 100 points or more.

In the present invention, an average secondary particle size of silica particles is preferably 10 nm or more and 1,000 nm or less, more preferably 30 nm or more and 300 nm or less, and particularly preferably 50 nm or more and 300 nm or less. The average secondary particle size of silica particles can be measured by a dynamic light scattering method.

Examples of silica particles include wet-process silica and fumed (dry process) silica. Examples of wet-process silica include gel-process silica obtained by conducting acid decomposition of a silicate to produce active silica, moderately polymerizing the active silica, and further gelling the polymerized silica; precipitation-process silica obtained by further precipitating the gel-process silica; and colloidal silica obtained by polymerizing active silica in the form of colloidal particles.

Examples of fumed (dry process) silica include silica obtained by a method (flame hydrolysis) in which a silicon halide is hydrolyzed in a vapor phase at a high temperature; and silica obtained by a method (arc process) in which quartz sand and coke are heated, reduced, and gasified by arc in an electric furnace, and the gas is oxidized with air.

In the present invention, from the viewpoint of improving scratch resistance, colloidal silica is preferably used. Among various types of colloidal silica, spherical colloidal silica is preferable because colloidal silica has high scratch resistance, and furthermore, higher transparency and thus color developability of an image is enhanced. Herein, the term "spherical" means that, when colloidal silica particles (50 particles or more and 100 particles or less) are observed with a scanning electron microscope, a ratio b/a of an average minor axis b to an average major axis a is in the range of 0.80 or more and 1.00 or less. The ratio b/a is more preferably 0.90 or more and 1.00 or less, and particularly preferably 0.95 or more and 1.00 or less. Furthermore, spherical cationic colloidal silica is preferable. Specific examples of spherical cationic colloidal silica include SNOWTEX AK and SNOWTEX AK-L (which are manufactured by Nissan Chemical Industries Ltd.).

An average primary particle size of colloidal silica is preferably 30 nm or more and 100 nm or less. When the average primary particle size is smaller than 30 nm, the effect of improving ink absorbency may not be sufficiently obtained. When the average primary particle size is larger than 100 nm, transparency decreases and the effect of improving color developability of an image may not be sufficiently obtained.

In the present invention, besides the alumina particles and the silica particles, other inorganic particles may be incorporated. Examples of the inorganic particles include particles composed of titanium dioxide, zeolite, kaolin, talc, hydrotalcite, zinc oxide, zinc hydroxide, aluminum silicate, calcium silicate, magnesium silicate, zirconium oxide, and zirconium hydroxide.

In the present invention, the content of inorganic particles in the ink-receiving layer is preferably 50% by mass or more and 98% by mass or less, and more preferably 70% by mass or more and 96% by mass or less. Herein, the term "content of inorganic particles" refers to the total content of alumina particles, silica particles, and the other inorganic particles. In particular, the total content of alumina particles and silica particles in the ink-receiving layer is preferably 50% by mass or more and 98% by mass or less, and more preferably 70% by mass or more and 96% by mass or less.

(Binder)

In the present invention, the ink-receiving layer contains a binder. In the present invention, the term "binder" refers a material that can bind inorganic particles such as alumina particles and silica particles and form a coat.

In the present invention, from the viewpoint of ink absorbency, the content of the binder in the ink-receiving layer is preferably 50.0% by mass or less, and more preferably 30.0% by mass or less relative to the content of the inorganic particles. From the viewpoint of a binding property of the ink-receiving layer, the proportion is preferably 5.0% by mass or more, and more preferably 8.0% by mass or more. In particular, the content of the binder is preferably 8.0% by mass or more and 30.0% by mass or less relative to the total content of alumina particles and silica particles.

Examples of the binder include starches such as oxidized starch, etherified starch, and esterified starch; latexes of styrene-butadiene copolymers, acrylonitrile-butadiene copolymers, or the like; polyvinyl alcohol and polyvinyl alcohol derivatives; casein; gelatin; carboxymethyl cellulose; polyvinylpyrrolidone; polyurethane polymers, vinyl acetate, and unsaturated polyester polymers. These binders may be used alone or in combination of two or more binders, as required.

Among the above binders, polyvinyl alcohol and polyvinyl alcohol derivatives are preferably used. Examples of the polyvinyl alcohol derivatives include cation-modified polyvinyl alcohol, anion-modified polyvinyl alcohol, silanol-modified polyvinyl alcohol and polyvinyl acetal. In the present invention, the binder is particularly preferably silanol-modified polyvinyl alcohol. As described above, in the present invention, the term "silanol-modified polyvinyl alcohol" refers to "polyvinyl alcohol having a silanol group". By using silanol-modified polyvinyl alcohol, a recording medium that satisfies the particular ratio of the amount of Si element to the total amount of Al element and Si element can be efficiently obtained.

Polyvinyl alcohol can be synthesized by, for example, saponifying polyvinyl acetate. The degree of saponification of polyvinyl alcohol is preferably 80% by mole or more and 100% by mole or less, and more preferably 85% by mole or more and 98% by mole or less. Note that the term "degree of saponification" refers to a ratio of the number of moles of hydroxyl group produced by a saponification reaction when polyvinyl alcohol is obtained by saponifying polyvinyl acetate. In the present invention, a value measured in accordance with the method described in JIS-K6726 is used as the degree of saponification. An average degree of polymerization of polyvinyl alcohol is preferably 2,000 or more, and more preferably 2,000 or more and 5,000 or less. In the present invention, a viscosity-average degree of polymerization determined by the method described in JIS-K6726 is used as the average degree of polymerization.

In preparation of an ink-receiving layer coating liquid, polyvinyl alcohol or a polyvinyl alcohol derivative is preferably used in the form of an aqueous solution. In such a case, the content of polyvinyl alcohol or the polyvinyl alcohol derivative in the aqueous solution is preferably 3% by mass or more and 20% by mass or less.

(Crosslinking Agent)

In the present invention, the ink-receiving layer further preferably contains a crosslinking agent. Examples of the crosslinking agent include aldehyde compounds, melamine compounds, isocyanate compounds, zirconium compounds, amide compounds, aluminum compounds, boric acids and borates. These crosslinking agents may be used alone or in combination of two or more compounds, as required. In particular, when polyvinyl alcohol or a polyvinyl alcohol derivative is used as the binder, among the cross-linking agents mentioned above, boric acids and borates are preferably used.

Examples of the boric acid include orthoboric acid ($H_3BO_3$), metaboric acid and diboric acid. The borate may be a water-soluble salt of a boric acid. Examples thereof include alkali metal salts of a boric acid such as a sodium salt of a boric acid and a potassium salt of a boric acid; alkaline earth metal salts of a boric acid such as a magnesium salt of a boric acid and a calcium salt of a boric acid; and ammonium salts of a boric acid. Among these boric acids and borates, orthoboric acid is preferably used from the viewpoint of the stability of the coating liquid with time, and an effect of suppressing the generation of cracks.

The amount of crosslinking agent used can be appropriately adjusted in accordance with production conditions etc. In the present invention, the content of the crosslinking agent in the ink-receiving layer is preferably 1.0% by mass or more and 50% by mass or less, and more preferably 5% by mass or more and 40% by mass or less relative to the content of the binder.

Furthermore, in the case where the binder is polyvinyl alcohol and the crosslinking agent is a boric acid and/or a borate, the total content of the boric acid and the borate relative to the content of polyvinyl alcohol in the ink-receiving layer is preferably 5% by mass or more and 30% by mass or less.

(Other Additives)

In the present invention, the ink-receiving layer may contain additives other than the components described above.

Specific examples of the additives include a pH adjustor, a thickener, a fluidity improver, an antifoaming agent, a foam inhibitor, a surfactant, a release agent, a penetrant, a color pigment, a color dye, a fluorescent brightening agent, an ultraviolet absorber, an antioxidant, an antiseptic agent, an antifungal agent, a waterproofing agent, a dye fixing agent, a curing agent and a weather resistant material.

<Undercoat Layer>

In the present invention, an undercoat layer may be provided between the support and the ink-receiving layer. By providing the undercoating layer, adhesiveness between the support and the ink-receiving layer can be improved. The undercoat layer preferably contains a water-soluble polyester polymer, gelatin, polyvinyl alcohol, etc. The thickness of the undercoat layer is preferably 0.01 μm or more and 5 μm or less.

<Back-Coat Layer>

In the present invention, a back-coat layer may be provided on a surface of the support, the surface being opposite to a surface on which the ink-receiving layer is provided. By providing the back coat layer, it is possible to improve handleability, conveying suitability, and conveyance scratch resistance during continuous printing in a state where a large number of sheets are stacked. The back coat layer preferably contains a white pigment, a binder, etc.

[Method for Producing Recording Medium]

In the present invention, a method for producing a recording medium may include a step of preparing a support, a step of preparing an ink-receiving layer coating liquid, and a step of applying the ink-receiving layer coating liquid onto the support. A method for producing a recording medium will be described below.

<Method for Preparing Support>

In the present invention, a commonly used method for making paper can be used as a method for preparing base paper. Examples of a paper machine include a Fourdrinier paper machine, a cylinder paper machine, a drum paper machine and a twin-wire paper machine. In order to increase the surface flatness and smoothness of base paper, a surface treatment may be performed by applying heat and a pressure either during or after a papermaking process. Specific examples of the surface treatment method include calendar treatments such as machine calendering and super calendaring.

Examples of a method for providing a polymer layer on base paper, that is, a method for coating base paper with a polymer, include a melt extrusion method, a wet lamination method and a dry lamination method. Among these methods, a melt extrusion method is preferable in which a molten polymer is extruded on a surface or both surfaces of base paper to coat the base paper with the polymer. An example of a widely used melt extrusion method is a method (also referred to as an "extrusion coating method") including bringing a polymer extruded from an extrusion die into contact with base paper that has been conveyed at a nip point between a nip roller and a cooling roller, and conducting pressure-bonding to laminate the base paper with a polymer layer. In the formation of a polymer layer by the melt extrusion method, a pretreatment may be conducted so that the base paper and the polymer layer more firmly adhere to each other. Examples of the pretreatment include an acid etching treatment with a mixture of sulfuric acid and chromic acid, a flame treatment with a gas flame, an ultraviolet irradiation treatment, a corona discharge treatment, a glow discharge treatment, and an anchor coating treatment with an alkyl titanate or the like. Among these pretreatments, a corona discharge treatment is preferable. In the case where a white pigment is incorporated in the polymer layer, the base paper may be coated with a mixture of a polymer and a white pigment.

The method preferably includes, before the formation of an ink-receiving layer, a step of winding the support prepared as described above around a winding core in a roll shape. A winding core having a diameter of 50 mm or more and 300 mm or less is preferably used as the winding core. The tension during winding is preferably 50 N/m or more and 800 N/m or less. The tension during winding may be constant from the start of winding to the end of winding. Alternatively, in order to reduce the concentration of the pressure at the start of winding, the tension may be gradually decreased from the start of winding to the end of winding.

<Method for Forming Ink-Receiving Layer>

For example, the following methods may be employed as a method for forming an ink-receiving layer on a support in the recording medium of the present invention. First, an ink-receiving layer coating liquid is prepared, and the coating liquid is then applied onto a support and dried. Thus, a recording medium of the present invention can be obtained. In a method for applying the coating liquid, for example, a curtain coater, a coater using an extrusion system, or a coater using a slide hopper system can be used. The coating liquid may be heated during coating. Examples of the drying method after coating include methods using a hot-air dryer such as a linear tunnel dryer, an arch dryer, an air-loop dryer, or a sine-curve air float dryer; and methods using a dryer that utilizes infrared rays, a heating dryer, microwaves, or the like.

In the present invention, a recording medium is preferably obtained by applying, onto a support, a coating liquid containing alumina particles and a coating liquid containing silica particles and polyvinyl alcohol having a silanol group by a simultaneous multilayer coating method. In the present invention, the term "simultaneous multilayer coating method" refers to a coating method in which a plurality of coating liquids are applied onto an inclined slide surface to form multiple layers in advance, and the multilayered coating liquids are transferred onto a support to form multiple ink-receiving layers. Herein, the term "simultaneous" does not mean that a plurality of layers are separately applied in a plurality of steps (for example, two layers are separately applied one by one in two steps) but means that a plurality of layers are applied in a single step. The coating liquids are preferably applied by this simultaneous multilayer coating method because a recording medium that satisfies the particular ratio of the amount of Si element to the total amount of Al element and Si element can be efficiently produced.

In the present invention, the dry coating amount of inorganic particles applied in the formation of an ink-receiving layer is preferably 8 $g/m^2$ or more and 45 $g/m^2$ or less. When the dry coating amount is in the above range, the above-described preferable thickness of an ink-receiving layer can be easily obtained. In particular, the dry coating amount of the coating liquid containing alumina particles is preferably 8 $g/m^2$ or more and 45 $g/m^2$ or less, and more preferably 15 $g/m^2$ or more and 42 $g/m^2$ or less. The dry coating amount of the coating liquid containing silica particles and polyvinyl alcohol having a silanol group is preferably 0.1 $g/m^2$ or more and 3.0 $g/m^2$ or less, and more preferably 0.3 $g/m^2$ or more and 2.0 $g/m^2$ or less.

EXAMPLES

The present invention will now be described in more detail using Examples and Comparative Examples. The present invention is not limited by Examples described below as long as it does not exceed the gist of the present invention. Note that the term "part" in the description of Examples below is on a mass basis unless otherwise specified.

[Preparation of Recording Medium]

<Preparation of Support>

Eighty parts of LBKP having a freeness of 450 mL in terms of Canadian Standard Freeness (CSF), 20 parts of NBKP having a freeness of 480 mL in terms of Canadian Standard Freeness (CSF), 0.60 parts of cationized starch, 10 parts of heavy calcium carbonate, 15 parts of light calcium carbonate, 0.10 parts of an alkyl ketene dimer, and 0.030 parts of cationic polyacrylamide were mixed. Water was added to the resulting mixture such that the mixture had a solid content of 3.0% by mass. Thus, a paper material was prepared. Subsequently, the paper material was subjected to paper making with a Fourdrinier paper machine, in which three-stage wet pressing was performed, followed by drying with a multi-cylinder dryer. The resulting paper was then impregnated with an aqueous solution of oxidized starch using a size press device so as to have a solid content of 1.0 g/m$^2$ after drying, and then dried. Furthermore, the paper was subjected to machine calender finishing, thus preparing base paper having a basis weight of 170 g/m$^2$, a Stockigt sizing degree of 100 seconds, an air permeability of 50 seconds, a Bekk smoothness of 30 seconds, a Gurley stiffness of 11.0 mN, and a thickness of 100 μm. Next, a polymer composition containing 70 parts of low-density polyethylene, 20 parts of high-density polyethylene, and 10 parts of titanium oxide was applied onto a surface (referred to as a "front surface") of the base paper such that the dry coating amount was 25 g/m$^2$. Furthermore, a polymer composition containing 50 parts of low-density polyethylene and 50 parts of high-density polyethylene was applied onto a back surface of the base paper such that the dry coating amount was 25 g/m$^2$. Thus, a support was prepared.

<Preparation of Inorganic Particle Dispersion Liquids>

(Preparation of Alumina Hydrate Dispersion Liquid)

To 333 parts of ion-exchange water, 1.65 parts of methanesulfonic acid was added as a deflocculating acid. While the resulting aqueous solution of methanesulfonic acid was stirred under a rotation condition of 3,000 rpm with a homomixer (T.K. Homomixer MARK-II 2.5 model, manufactured by Tokusyu Kika Kogyo Co., Ltd.), 100 parts of alumina hydrate DISPERAL HP14 (having an average secondary particle size of 140 nm) (manufactured by Sasol) was added thereto little by little. After the completion of the addition, stirring was continued for 30 minutes without further treatment. Thus, an alumina hydrate dispersion liquid having a solid content of 23% by mass was prepared.

(Preparation of Fumed Alumina Dispersion Liquid)

To 333 parts of ion-exchange water, 1.65 parts of methanesulfonic acid was added as a deflocculating acid. While the resulting aqueous solution of methanesulfonic acid was stirred under a rotation condition of 3,000 rpm with a homomixer (T.K. Homomixer MARK-II 2.5 model), 100 parts of fumed γ-alumina AEROXIDE Alu C (having an average secondary particle size of 160 nm) (manufactured by EVONIK Industries) was added thereto little by little. After the completion of the addition, stirring was continued for 30 minutes without further treatment. Thus, a fumed alumina dispersion liquid having a solid content of 23% by mass was prepared.

(Preparation of Fumed Silica Dispersion Liquid 1)

In a suction-type dispersion stirring device Conti-TDS (manufactured by YSTRAL), 5 parts of a dimethyl diallyl ammonium chloride homopolymer (SHALLOL DC902P) (manufactured by Dai-Ichi Kogyo Seiyaku Co., Ltd.) was added relative to 420 parts of ion-exchange water. Furthermore, 100 parts of fumed silica AEROSIL 50 (having an average primary particle size of 30 nm) (manufactured by Nippon Aerosil Co., Ltd.) was added thereto little by little at the maximum number of revolutions, and dispersion was conducted for 24 hours. Thus, a fumed silica dispersion liquid 1 having a solid content of 20% by mass was obtained.

(Preparation of fumed silica dispersion liquid 2)

A fumed silica dispersion liquid 2 having a solid content of 20% by mass was obtained as in the above (preparation of fumed silica dispersion liquid 1) except that AEROSIL 50 was changed to AEROSIL 200 (having an average primary particle size of 12 nm) (manufactured by Nippon Aerosil Co., Ltd.).

(Colloidal Silica Dispersion Liquid)

The colloidal silica dispersion liquids described in Table 1 below were used.

TABLE 1

Type of colloidal silica dispersion liquids

| Product name | Name of manufacturer | Average primary particle size (nm) |
|---|---|---|
| ST-AK-L | Nissan Chemical Industries Ltd. | 45 |
| ST-AK | | 15 |
| ST-O-40 | | 22 |
| MP-1040 | | 100 |
| PL-3L | Fuso Chemical Co., Ltd. | 35 |
| PL-20 | | 200 |
| Cartacoat K303C | Clariant K.K. | 80 |

<Preparation of Ink-Receiving Layer Coating Liquids>

(Preparation of Coating Liquids 1-1 to 1-5)

Coating liquids 1-1 to 1-5 were prepared by mixing the inorganic particle dispersion liquids prepared above, polyvinyl alcohol PVA 235 (manufactured by Kuraray Co., Ltd.) serving as a binder, and orthoboric acid serving as a crosslinking agent so that the numbers of parts of the solid contents became the values shown in Table 2, and used.

TABLE 2

Preparation conditions of coating liquids (Unit: Number of parts)

| Coating liquid No. | Inorganic particles: Alumina hydrate dispersion liquid | Inorganic particles: Fumed alumina dispersion liquid | Inorganic particles: Fumed silica dispersion liquid 2 | Binder | Crosslinking agent |
|---|---|---|---|---|---|
| Coating liquid 1-1 | 80.0 | 20.0 | 0 | 10.0 | 1.2 |
| Coating liquid 1-2 | 100.0 | 0 | 0 | 10.0 | 1.2 |
| Coating liquid 1-3 | 0 | 100.0 | 0 | 10.0 | 1.2 |
| Coating liquid 1-4 | 0 | 0 | 100.0 | 22.0 | 4.0 |
| Coating liquid 1-5 | 0 | 10.0 | 90.0 | 22.0 | 4.0 |

(Preparation of Coating Liquids 2-1 to 2-10)

Coating liquids 2-1 to 2-10 were prepared by mixing an inorganic particle dispersion liquid prepared above, polyvinyl alcohol PVA 235 ("PVA" in Table 3) or silanol-modified polyvinyl alcohol R-1130 (manufactured by Kuraray Co., Ltd.) ("silanol-modified PVA" in Table 3) serving as a binder, orthoboric acid serving as a crosslinking agent, and Surfynol 440 (manufactured by Nissin Chemical Co., Ltd.), which is an acetylenediol surfactant so that the numbers of parts of the solid contents became the values shown in Table 3, and used.

TABLE 3

| Preparation conditions of coating liquids | | | | | | | | |
|---|---|---|---|---|---|---|---|---|
| | Inorganic particles | | | | Binder | | | |
| Coating liquid No. | Type | Product name | Average primary particle size (nm) | Content (part) | Type | Content (part) | Crosslinking agent (part) | Surfactant (part) |
| Coating liquid 2-1 | Colloidal silica | ST-AK-L | 45 | 100.0 | Silanol-modified PVA | 11.0 | 0.4 | 0.5 |
| Coating liquid 2-2 | Colloidal silica | ST-AK | 15 | 100.0 | Silanol-modified PVA | 11.0 | 0.4 | 0.5 |
| Coating liquid 2-3 | Colloidal silica | ST-O-40 | 22 | 100.0 | Silanol-modified PVA | 11.0 | 0.4 | 0.5 |
| Coating liquid 2-4 | Colloidal silica | PL-3L | 35 | 100.0 | Silanol-modified PVA | 11.0 | 0.4 | 0.5 |
| Coating liquid 2-5 | Colloidal silica | Cartacoat K303C | 80 | 100.0 | Silanol-modified PVA | 11.0 | 0.4 | 0.5 |
| Coating liquid 2-6 | Colloidal silica | MP-1040 | 100 | 100.0 | Silanol-modified PVA | 11.0 | 0.4 | 0.5 |
| Coating liquid 2-7 | Colloidal silica | PL-20 | 200 | 100.0 | Silanol-modified PVA | 11.0 | 0.4 | 0.5 |
| Coating liquid 2-8 | Fumed silica 1 | Aerosil 50 | 30 | 100.0 | Silanol-modified PVA | 22.0 | 4.0 | 0.5 |
| Coating liquid 2-9 | Fumed silica 2 | Aerosil 200 | 12 | 100.0 | Silanol-modified PVA | 22.0 | 4.0 | 0.5 |
| Coating liquid 2-10 | Colloidal silica | ST-AK-L | 45 | 100.0 | PVA | 11.0 | 0.4 | 0.5 |

(Preparation of Coating Liquid 2-11)

Coating liquid 2-11 was prepared by mixing coating liquid 1-1 and coating liquid 2-1 prepared as described above in a mass ratio of 1:9.

<Preparation of Recording Medium>

The ink-receiving layer coating liquid prepared as described above was applied onto the support prepared as described above. In the case where two coating liquids (first coating liquid and second coating liquid) were applied, the coating was performed by the simultaneous multilayer coating method using a multilayer slide hopper coating apparatus so that the dry coating amounts (g/m$^2$) of the coating liquids became the values shown in Table 4. Furthermore, after the coating, drying was conducted with hot air at 120° C. to obtain recording media. For each of the recording media, a composition analysis was conducted by X-ray photoelectron spectroscopy while etching was performed under the etching condition and analysis conditions described above. The ratios of the amount of Si element to the total amount of Al element and Si element (Si element/Al element+Si element) at etching times of 0 minutes, 5 minutes, and 20 minutes were obtained. The results are shown in Table 4.

TABLE 4

| Preparation conditions of recording media and results of composition analysis | | | | | | | |
|---|---|---|---|---|---|---|---|
| | Preparation conditions of recording medium | | | | Results of composition analysis Si element/Al element + Si element (atom %) | | |
| | First coating liquid | | Second coating liquid | | | | |
| Example No. | Coating liquid No. | Dry coating amount (g/m$^2$) | Coating liquid No. | Dry coating amount (g/m$^2$) | Etching time 0 minutes | Etching time 5 minutes | Etching time 20 minutes |
| Example 1 | Coating liquid 1-1 | 35.0 | Coating liquid 2-1 | 2.0 | 89 | 99 | 85 |
| Example 2 | Coating liquid 1-1 | 35.0 | Coating liquid 2-1 | 0.3 | 40 | 50 | 0 |
| Example 3 | Coating liquid 1-1 | 35.0 | Coating liquid 2-2 | 1.2 | 53 | 81 | 23 |
| Example 4 | Coating liquid 1-1 | 35.0 | Coating liquid 2-3 | 1.2 | 61 | 75 | 29 |

TABLE 4-continued

Preparation conditions of recording media and results of composition analysis

| Example No. | Preparation conditions of recording medium: First coating liquid: Coating liquid No. | Dry coating amount ($g/m^2$) | Second coating liquid: Coating liquid No. | Dry coating amount ($g/m^2$) | Results of composition analysis Si element/Al element + Si element (atom %): Etching time 0 minutes | Etching time 5 minutes | Etching time 20 minutes |
|---|---|---|---|---|---|---|---|
| Example 5 | Coating liquid 1-1 | 35.0 | Coating liquid 2-4 | 1.2 | 70 | 85 | 17 |
| Example 6 | Coating liquid 1-1 | 35.0 | Coating liquid 2-5 | 1.2 | 72 | 89 | 34 |
| Example 7 | Coating liquid 1-1 | 35.0 | Coating liquid 2-6 | 1.2 | 70 | 92 | 36 |
| Example 8 | Coating liquid 1-1 | 35.0 | Coating liquid 2-7 | 1.2 | 64 | 85 | 40 |
| Example 9 | Coating liquid 1-1 | 35.0 | Coating liquid 2-8 | 1.2 | 72 | 88 | 0 |
| Example 10 | Coating liquid 1-1 | 35.0 | Coating liquid 2-9 | 1.2 | 96 | 88 | 0 |
| Example 11 | Coating liquid 1-1 | 35.0 | Coating liquid 2-9 | 0.4 | 80 | 92 | 2 |
| Example 12 | Coating liquid 1-2 | 35.0 | Coating liquid 2-1 | 1.2 | 70 | 96 | 26 |
| Example 13 | Coating liquid 1-3 | 35.0 | Coating liquid 2-1 | 1.2 | 68 | 88 | 26 |
| Example 14 | Coating liquid 1-1 | 35.0 | Coating liquid 2-1 | 1.6 | 83 | 97 | 78 |
| Example 15 | Coating liquid 1-1 | 35.0 | Coating liquid 2-1 | 1.2 | 65 | 83 | 34 |
| Example 16 | Coating liquid 1-1 | 35.0 | Coating liquid 2-1 | 1.0 | 61 | 85 | 29 |
| Example 17 | Coating liquid 1-1 | 35.0 | Coating liquid 2-1 | 0.6 | 53 | 65 | 18 |
| Example 18 | Coating liquid 1-1 | 35.0 | Coating liquid 2-1 | 0.4 | 45 | 55 | 2 |
| Example 19 | Coating liquid 1-4 | 22.0 | Coating liquid 2-11 | 1.2 | 75 | 91 | 98 |
| Example 20 | Coating liquid 1-5 | 22.0 | Coating liquid 2-1 | 1.2 | 88 | 97 | 88 |
| Com. Ex. 1 | — | 0 | Coating liquid 2-1 | 1.2 | 97 | 98 | 99 |
| Com. Ex. 2 | Coating liquid 1-1 | 35.0 | — | 0 | 0 | 0 | 0 |
| Com. Ex. 3 | — | 0 | Coating liquid 2-10 | 1.2 | 98 | 97 | 97 |
| Com. Ex. 4 | Coating liquid 1-1 | 35.0 | Coating liquid 2-1 | 2.2 | 93 | 100 | 93 |
| Com. Ex. 5 | Coating liquid 1-1 | 35.0 | Coating liquid 2-8 | 2.2 | 94 | 96 | 85 |
| Com. Ex. 6 | Coating liquid 1-1 | 35.0 | Coating liquid 2-9 | 2.2 | 93 | 96 | 88 |
| Com. Ex. 7 | Coating liquid 1-4 | 22.0 | Coating liquid 2-1 | 1.2 | 97 | 98 | 100 |
| Com. Ex. 8 | Coating liquid 1-4 | 22.0 | Coating liquid 1-1 | 0.4 | 4 | 52 | 64 |
| Com. Ex. 9 | Coating liquid 1-1 | 35.0 | Coating liquid 2-1 | 0.1 | 11 | 32 | 0 |
| Com. Ex. 10 | Coating liquid 1-1 | 35.0 | Coating liquid 2-1 | 0.3 | 25 | 40 | 0 |
| Com. Ex. 11 | Coating liquid 1-1 | 35.0 | Coating liquid 2-10 | 1.2 | 83 | 46 | 36 |
| Com. Ex. 12 | Coating liquid 1-1 | 35.0 | Coating liquid 2-10 | 0.4 | 61 | 28 | 16 |

Com. Ex.: Comparative Example

[Evaluation]

In the present invention, AA to B in evaluation criteria of each of the evaluation items described below were considered to be preferred levels, and C and D in the evaluation criteria were considered to be unacceptable levels. When an image was recorded on a recording medium in each of the evaluations described below, the recording was conducted at a temperature of 23° C. and at a relative humidity of 50% using an ink jet recording apparatus PIXUS MP990 (manufactured by CANON KABUSHIKI KAISHA) including an ink cartridge BCI-321 (manufactured by CANON KABUSHIKI KAISHA) therein. In the above ink jet recording apparatus, an image recorded under the conditions that an approximately 11 ng ink droplet is provided in a unit region of 1/600 inch×1/600 inch at a resolution of 600 dpi×600 dpi is defined as having a recording duty of 100%.

(Evaluation of Ink Absorbency)

Four green solid images having recording duties of 200%, 250%, 300%, and 350% were recorded on each of the recording media using the ink jet recording apparatus. Ink absorbency was evaluated by visually observing the occurrence or non-occurrence of a beading phenomenon in the images. The term "beading phenomenon" refers to a phenomenon in which ink droplets before being absorbed in a recording medium are combined with each other. It is known that the beading phenomenon is highly correlated with the ink absorbency. That is, when the beading phenomenon does not occur even in an image having a high recording duty, it is determined that the ink absorbency of a recording medium is high. The evaluation criteria are as follows. The evaluation results are shown in Table 5.

AA: The beading phenomenon did not occur even in the image having a recording duty of 350%.

A: The beading phenomenon occurred in the image having a recording duty of 350% but did not occur in the image having a recording duty of 300%.

B: The beading phenomenon occurred in the image having a recording duty of 300% but did not occur in the image having a recording duty of 250%.

C: The beading phenomenon occurred in the image having a recording duty of 250% but did not occur in the image having a recording duty of 200%.

D: The beading phenomenon occurred even in the image having a recording duty of 200%.

(Evaluation of Color Developability of Image)

A black solid image having a recording duty of 100% was recorded on each of the recording media using the ink jet recording apparatus. An optical density of the image was measured with an optical reflection densitometer (530 spectrodensitometer) (manufactured by X-Rite Inc.). Color developability of the image was evaluated by the criteria described below. The evaluation results are shown in Table 5.

AA: The optical density of an image was 2.30 or more.

A: The optical density of an image was 2.20 or more and less than 2.30.

B: The optical density of an image was 2.10 or more and less than 2.20.

C: The optical density of an image was 2.00 or more and less than 2.10.

D: The optical density of an image was less than 2.00.

(Evaluation of Scratch Resistance)

Scratch resistance of each of the recording media was evaluated by using a Gakushin-type rubbing tester II (manufactured by Tester Sangyo Co., Ltd.) in accordance with JIS-L0849. Specifically, the evaluation was performed as follows. A recording medium was set on a vibration table of the rubbing tester so that the ink-receiving layer was disposed on the upper side. A friction element on which a weight of 100 g had been placed was covered with Kimtowel, and was reciprocally moved so as to rub against the surface of the recording medium five times. Subsequently, a 20° glossiness in a portion that was rubbed with the friction element and a 20° glossiness in a portion that was not rubbed were measured. The difference in the 20° glossiness [=(20° glossiness in the portion that was rubbed)−(20° glossiness in the portion that was not rubbed)] was calculated. In the rubbed portion, the lower the scratch resistance of a recording medium, the higher the 20° glossiness tends to be, and thus the larger the difference in the 20° glossiness. The 20° glossiness was measured by the method described in JIS-Z8741. The evaluation criteria are as follows. The evaluation results are shown in Table 5.

AA: The difference in the 20° glossiness was less than 2%.

A: The difference in the 20° glossiness was 2% or more and less than 5%.

B: The difference in the 20° glossiness was 5% or more and less than 10%.

C: The difference in the 20° glossiness was 10% or more and less than 15%.

D: The difference in the 20° glossiness was 15% or more.

(Evaluation of Glossiness)

The 20° glossiness of each of the recording media was measured by the method described in JIS-Z8741. Glossiness was evaluated by the criteria described below. The evaluation results are shown in Table 5.

AA: The 20° glossiness was 25% or more.

A: The 20° glossiness was 20% or more and less than 25%.

B: The 20° glossiness was 15% or more and less than 20%.

C: The 20° glossiness was 10% or more and less than 15%.

D: The 20° glossiness was less than 10%.

TABLE 5

| | Evaluation results | | | |
|---|---|---|---|---|
| | Evaluation results | | | |
| Example No. | Ink absorbency | Color developability of image | Scratch resistance | Glossiness |
| Example 1 | B | B | AA | AA |
| Example 2 | AA | AA | B | AA |
| Example 3 | B | A | B | AA |
| Example 4 | B | A | B | AA |
| Example 5 | A | AA | AA | AA |
| Example 6 | AA | A | AA | AA |
| Example 7 | AA | A | AA | AA |
| Example 8 | AA | B | AA | A |
| Example 9 | AA | B | B | B |
| Example 10 | B | B | B | B |
| Example 11 | A | B | B | B |
| Example 12 | B | A | AA | AA |
| Example 13 | AA | B | AA | AA |
| Example 14 | B | B | B | AA |
| Example 15 | A | A | AA | AA |
| Example 16 | A | AA | AA | AA |
| Example 17 | AA | AA | A | AA |
| Example 18 | AA | AA | B | AA |
| Example 19 | AA | A | AA | AA |
| Example 20 | B | B | AA | AA |
| Comparative Example 1 | C | D | C | AA |
| Comparative Example 2 | AA | AA | D | B |
| Comparative Example 3 | D | D | B | AA |
| Comparative Example 4 | D | D | C | AA |
| Comparative Example 5 | AA | D | B | B |
| Comparative Example 6 | C | B | B | B |
| Comparative Example 7 | D | C | AA | AA |
| Comparative Example 8 | AA | A | D | B |
| Comparative Example 9 | AA | AA | C | A |
| Comparative Example 10 | AA | AA | C | A |
| Comparative Example 11 | C | A | C | AA |
| Comparative Example 12 | A | A | D | AA |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-131660, filed Jun. 24, 2013, which is hereby incorporated by reference herein in its entirety.

What is claimed is:

1. A recording medium comprising:

a support; and an ink-receiving layer, wherein the ink-receiving layer contains alumina particles, silica particles and a binder, wherein for a composition analysis of the recording medium performed by X-ray photoelectron spectroscopy while etching is performed from a surface side to a support side in a direction substantially perpendicular to a surface of the recording medium using argon gas under application of a power of 25.6 W (4 kV×6.4 μA) at an etching angle of 45 degrees, a ratio of the amount of Si element to the total amount of Al element and Si element at an etching time of 0 minutes is 10 atomic percent or more and 90 atomic percent or less and a ratio of the amount of Si element to the total amount of Al element and Si element at an etching time of 5 minutes is 50 atomic percent or more, and wherein the binder is polyvinyl alcohol having a silanol group.

2. The recording medium according to claim 1, wherein the ratio of the amount of Si element to the total amount of Al element and Si element at an etching time of 20 minutes is 90 atomic percent or less.

3. The recording medium according to claim 1, wherein the silica particles are colloidal silica having an average primary particle size of 30 nm or more and 100 nm or less.

4. The recording medium according to claim 1, wherein the alumina particles have an average secondary particle size of 50 nm or more and 300 nm or less.

5. The recording medium according to claim 1, wherein the ink-receiving layer contains, as the alumina particles, alumina hydrate and fumed alumina.

6. The recording medium according to claim 1, wherein a total content of the alumina particles and the silica particles in the ink-receiving layer is 50% by mass or more and 98% by mass or less.

7. The recording medium according to claim 1, wherein a content of the binder in the ink-receiving layer is 8.0% by mass or more and 30.0% by mass or less relative to a total content of the alumina particles and the silica particles.

8. The recording medium according to claim 1, wherein the ink-receiving layer is obtained by applying, onto the support, a coating liquid containing alumina particles and a coating liquid containing silica particles and polyvinyl alcohol having a silanol group by a simultaneous multilayer coating method.

9. The recording medium according to claim 8, wherein a dry coating amount of the coating liquid containing alumina particles is 15 $g/m^2$ or more and 42 $g/m^2$ or less, and a dry coating amount of the coating liquid containing silica particles and polyvinyl alcohol having a silanol group is 0.3 $g/m^2$ or more and 2.0 $g/m^2$ or less.

* * * * *